United States Patent [19]

Swingler

[11] 4,303,865

[45] Dec. 1, 1981

[54] COLD CATHODE ION SOURCE

[75] Inventor: Donald L. Swingler, Park Orchards, Australia

[73] Assignee: Commonwealth Scientific & Industrial Research Organization, Campbell, Australia

[21] Appl. No.: 69,409

[22] Filed: Aug. 24, 1979

[30] Foreign Application Priority Data

Aug. 25, 1978 [AU] Australia ..... PD5679
Apr. 26, 1979 [AU] Australia ..... PD8542

[51] Int. Cl.[3] ..... H01J 27/00

[52] U.S. Cl. ..... 250/423 R; 250/288; 250/396 R; 250/294

[58] Field of Search ..... 250/423, 288, 396 R, 250/396 ML, 294

[56] References Cited

U.S. PATENT DOCUMENTS 3,100,260 8/1963 Wilska ..... 250/396
3,835,319 9/1974 Roehrig et al. ..... 250/423
4,189,640 2/1980 Dawson ..... 250/396 ML

*Primary Examiner*—H. Dixon
*Attorney, Agent, or Firm*—Sughrue, Mion, Zinn, Macpeak & Seas

[57] ABSTRACT

A plasma discharge ion source for a mass spectrometer, having a magnet forming an axial magnetic field, two cathodes axially spaced in said field and an annular anode between the cathodes. Ions generated by the source emerge via an opening in one cathode and then pass in succession through axially aligned openings in two planar electrodes. The electrode closest said one cathode has a further disc or cone shaped electrode positioned in the opening of that electrode so as to form an annular gap between the peripheries of the disc shaped electrode and opening.

Ions from the source opening pass in succession through the annular gap and then through the electrode opening in the electrode furtherest from the source opening. By applying suitable electric potentials to the electrodes ions of an energy above a predetermined level are prevented from passing through the electrodes.

A mass spectrometer employing the source is also disclosed this employing an electrostatic ion filter and an ion collector to receive filtered ions from the source via the filter.

The collector includes a slow ion deflector arranged to deflect emergent ions from the filter to a collector member of the collector and to which deflector emergent ions of high energy travel directly without such deflection.

9 Claims, 6 Drawing Figures

COLD CATHODE ION SOURCE

BACKGROUND OF THE INVENTION (i) Field of the Invention

This invention relates to plasma discharge devices, particularly but not exclusively adapted for use in mass spectrometers using electrostatic mass filters.

(ii) Prior Art

Mass spectrometers utilizing electrostatic mass filters such as quadropole mass filters are well known. Such spectrometers are arranged so that ions of a gas or vapour to be analysed are generated in an ion source and directed into the mass filter, filtered ions being detected by a suitable detector.

The ion source used in a mass spectrometer of the above kind may take in a number of forms, but in the past it has been customary to use electron impact devices. However, plasma discharge devices, such as the known "Penning discharge" device, are known to have desirable characteristics making them particularly suitable for use as ion sources, but these have not found favour because of an unsatisfactory energy distribution of ions produced from such devices. In particular, substantial quantities of high energy ions are normally produced and these tend to travel through the mass filter regardless of mass, so resulting in a downgrading of the filtering characteristics of the mass filter. Solutions to this problem have been proposed. For example, an effective mass spectrometer using a particular form of plasma discharge device is described in the publication NASA CR-1475 of the National Aeronautical Aeronautics and Space Administration, entitled "A Cold Cathode Ion Source Mass Spectrometer Employing Ion Counting Techniques" by F. L. Torney Jr., P. Blum, P. Fowler and J. R. Roehrig. However, this device is relatively complex.

Against the above background, an object of the present invention is to provide an improved ion source which is arranged to limit the energy spread of ions produced thereby but which is of relatively simple construction.

BRIEF SUMMARY OF THE INVENTION

According to the invention there is provided an ion source having two axially spaced cathodes and an anode interposed between the cathodes, the anode being of generally annular cross-section transverse to the axis of the source, and structure including first and second parts positioned at respective opposite axial ends of said anode and in use generating a magnetic field aligned in the direction of said axis and extending between said cathodes, so that when positive potential is applied to said anode, ions of a gas or vapour introduced into the ion source are generated; the ion source being arranged so as in use to direct said ions to move away from said anode axially past one said cathode and an adjacent one of said structure parts; a first electrode being positioned on said axis and adjacent an axially positioned aperture in a second electrode extending transversely to said axis so that there is defined between said first and second electrodes a generally annular opening whereby in use of the source with a positive potential applied to both said electrodes an electrostatic field is created at or around the said first electrode so directed as to effect rejection of ions having energies outside a predetermined energy band. In use of the ion source with a mass spectrometer, the field produced in said annular opening is employed to guide the accepted ions ultimately into the mass filter. Preferably, a further apertured electrode is provided with an axially aligned opening positioned in the path of ions from said first and second electrodes and spaced away from the first and second electrodes such that ions within said energy band can pass, in use of the source, through the said annular opening and thence through the last mentioned opening, but such that at least ions of energy above said level are rejected by failure to pass either through said annular opening or through the further opening. Preferably said further electrode is provided, in use, with a zero potential relative to the potential of said structure. Preferably, the source is provided with an axially elongate member of conductive but non-magnetic material which extends from the said part of said structure which is opposite the said one part, through the said anode but spaced from the inner periphery of the anode, to terminate at a location adjacent said anode but between said anode and said one part. When the ion source of the invention is used in a mass spectrometer, the effectiveness of the spectrometer may be further enhanced by using an ion collector of known form, being that described in Australian Patent No. 410,813. Thus, the invention further provides a mass spectrometer having, spaced in an axial direction thereof, an ion source, a collector, and an electrostatic mass filter interposed between these, the ion source being of the kind described above, and the mass filter in use having predetermined electrical potential applied thereto to cause it to generate an electrostatic field such that ions from said ion source and of particular energy are passed along a predetermined path from the filter to the collector, and said collector comprising a collector member disposed away from said path and in use having a potential applied thereto such as to attract, from ions passing through the filter only ions which have energy levels in a particular range for which the filter is effective and such that ions of energy level at least well above this range are not deflected from said path sufficiently to be collected.

The collector member may be of a shallow cylindrical form concentric with the axis of the mass spectrometer, with an inwardly directed flange at the end thereof closest the filter. A further member may be positioned substantially on said axis and positioned so that said collector member extends substantially therearound, this further member being arranged to carry, in use, a second electrical potential such as to repel ions of energy within said range but such that ions of energy at least well above said range are able to continue substantially undeflected thereto in their movement from the filter.

The mass filter is normally a quadrupole type, but other types such as the monopole type may be employed.

BRIEF DESCRIPTION OF THE DRAWINGS

The invention is further described with reference to the accompanying drawings, in which.

DETAILED DESCRIPTION

Figure 1:
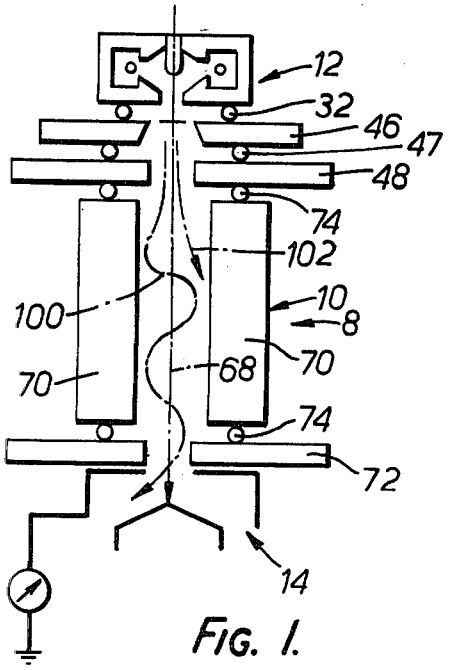
FIG. 1 is a diagrammatic view of a mass spectrometer having an ion source constructed in accordance with the invention.

The mass spectrometer 8 shown in FIG. 1 includes a quadrupole mass filter 10 positioned between a ion source 12 and an ion collector 14 so that by application of suitable voltages to these parts ions generated in the source 12 are selectively passed through the filter and detected at the collector 14.

By scanning of voltage conditions of the filter 10, ions of differing masses are, over a scan period, able to pass from the source 12 through the filter to reach the collector 14 at differing times in the scan period so that by, for example, preparing a graph of collector current against scan time, peaks in the graph will be indicative of the masses of ions which have travelled through the filter.

Filter 10 is of the usual quadrupole form having four lengthwise extending rods arranged in equiangularly spaced array about a common pitch circle defined about the axis of the spectrometer. Only two of these rods, indicated by reference numerals 70, are shown in the drawings. The rods are supported between an electrode 48 at one end and a plate 72 at the other end, being separated from the electrode and plate by ruby balls 74 which insulate the rods from the electrode and plate. As described later, both electrode 48 and plate 72 are apertured so that ions from source 12 can pass into the mass filter via electrode 48 and can leave the mass filter via plate 72 to pass to the collector 14.

Figure 2:
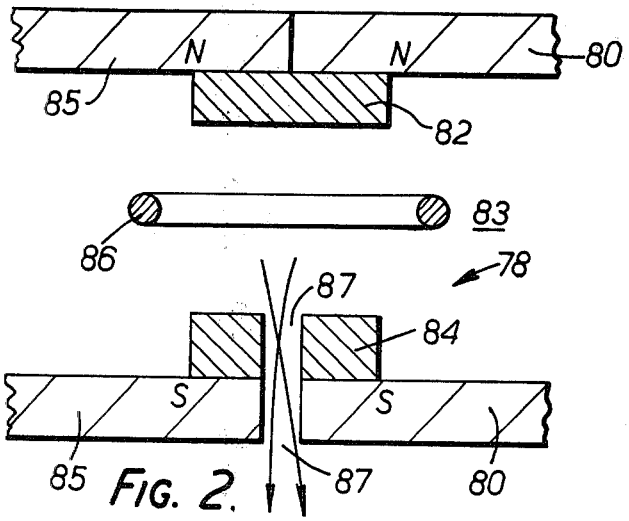
FIG. 2 is a diagrammatic axial section of a known form of ion source.

Ion source 12 is a particular novel form of plasma discharge device of the type known as a "Penning" discharge device: FIG. 2 shows a conventional form of an ion source 78 which operates as a "Penning" discharge device.

Source 78 includes two "horseshoe" magnets 80, 85 arranged to define a magnetic field which extends axially of the spectrometer. In particular, the magnets present a north pole at one end of an open space 83 and a south pole at the other end thereof. Two axially spaced cathodes 82, 84 are provided at opposite ends of the space 83 and a wire anode 86 of annular form is positioned between the cathodes 82, 84 being spaced from each of the cathodes. Cathode 84 and the magnets 80 at the south pole end of the source have an opening 87 therethrough for exit of ions from the ion source 78.

The mode of operation of source 78 is well known and is described in detail, for example, in "Proceedings of the I.R.E.", December, 1961 at page 1920 in an article entitled "Electrical Characteristics of a Penning Discharge", J. C. Helmer and R. L. Jepson. Briefly, however, the cathodes 82, 84 are in use maintained at a common voltage some kilovolts lower than the positive potential applied to the anode 86. It is firstly supposed that, in use, the anode 86 encircles an electron cloud, electrons of which are contained in cycloidal electron orbits which extend in planes transverse to the spectrometer axis. The orbits are smaller in diameter than the diameter of the anode, so that electrons in these orbits cannot reach the anode. Molecules of introduced gas or vapour in space 83 can be ionized by electrons within the electron cloud, with the so-produced ions being driven into one of the cathodes by a strong electric field produced by the substantial electrical potential difference between the anode and the cathodes, giving rise to secondary emission of electrons. In any event, ions of the introduced gas which are driven towards cathode 84 will, if they are substantially close to being on axis, pass through the opening 87 to pass to mass filter 10.

Figure 5:
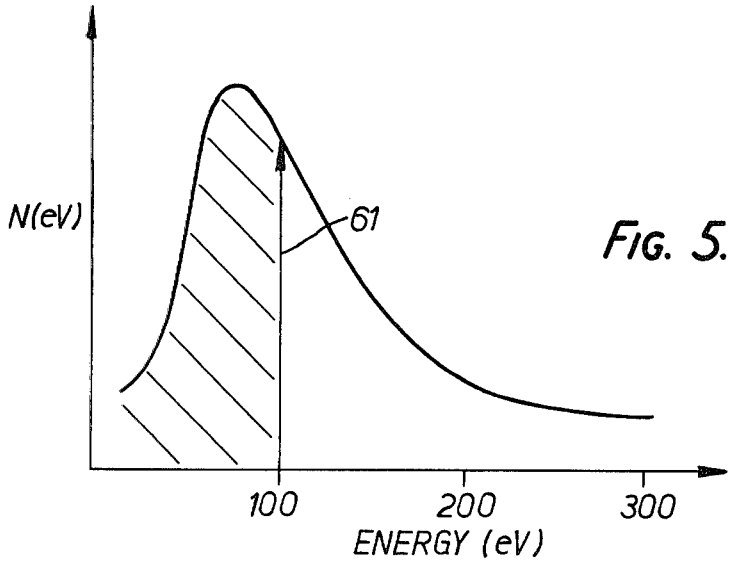
FIG. 5 is a diagram showing the energy distribution of ions produced in the ion sources of FIGS. 2 and 4.

As illustrated in FIG. 5, the source 78 generates substantial numbers of ions at a variety of different energies. Although the energy spectrum thus shown exhibits a pronounced peak at one particular energy level, there are considerable numbers of ions having higher energies. In fact there may be substantial numbers of ions having energies ranging up to the high electrical potential applied to the anode. Although in the presently described construction, the manner of construction of collector 14 is such as to offer a discrimination between such high energy level ions and ions which have travelled through the mass filter in the manner required for proper operation of the spectrometer, effective operation of the spectrometer can still be interfered with by presence of high energy ions since these may lose sufficient energy in the filter 10 such as to pass to the collector 14 irrespective of their mass.

The ions source 12 of the invention is generally similar to the source 78, but is modified so as, in effect, to block passage of high energy ions therefrom, so that such ions are not introduced into the filter 10 to cause the difficulties referred to above.

Source 12 includes two permanent magnets 18, 19 which provide opposed north and south poles and which have respective opposed cathodes 22, 24 associated therewith. Cathode 24 has a central axial opening 25. An annular anode 26 is positioned co-axially of the spectrometer and in the space 20 between the cathodes 22, 24. In this respect, the source 12 is thus analagous to the source 78.

The structure including magnets 18, 19 and anode 26 is mounted on a plate-like electrode 46 with insulating ruby balls 32 positioned therebetween. Electrode 46 is in turn mounted on electrode 48 and is separated from electrode 48 by further insulating ruby balls 47.

An axially elongate cylindrical element 42 of conductive but non-magnetic material, such as aluminium, extends from cathode 22 towards cathode 24 so as to pass concentrically through the anode 26 but to be spaced well inwardly of the inner periphery of the anode. Element 42 extends from cathode 22 just past the position of anode 26 and thus terminates well short of cathode 24.

Electrodes 46 and 48 are positioned between cathode 24 and the entrance to the mass filter 10. Electrodes 46 and 48 are apertured to permit ions to pass from the magnet structure formed by magnets 18 and 19, through electrode 46 and electrode 48 and thence to the mass filter 10. Thus, electrode 46 has a central axially aligned circular opening **46*a* of rather greater diameter than the diameter of the opening 25 in cathode 24. Likewise, electrode 48 has an axially aligned opening 48*a*. An electrode 44 of circular form and of slightly greater diameter than opening 25 is positioned in opening 46*a*. Electrode 44 is a relatively thin material, measured in the axial direction of the spectrometer, and is also aligned generally with the upper surface 46*b* of electrode 46, and is centrally positioned within opening 46*a* so as to present an annular gap 50 between the periphery of electrode 44** and the periphery of the opening 46a. As shown, electrode 44 is axially spaced away from but adjacent to cathode 24.

Figure 3:
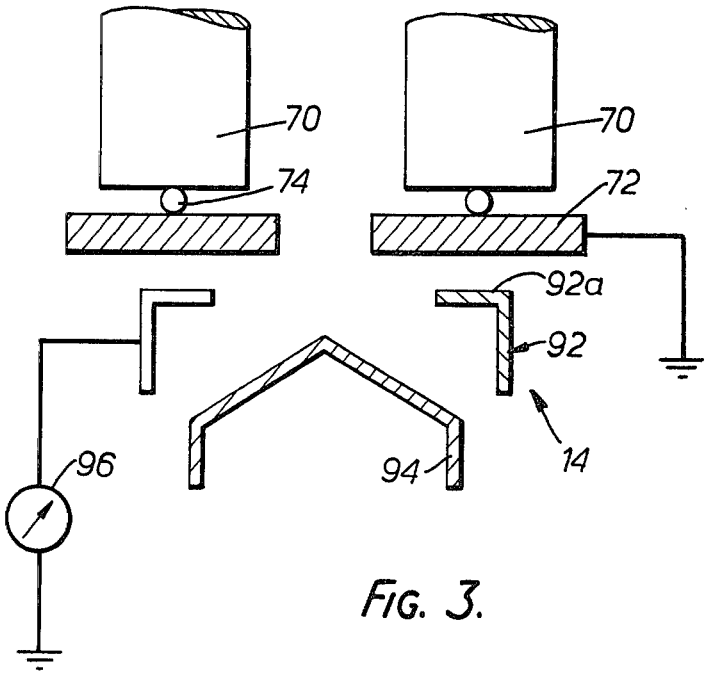
FIG. 3 is a diagrammatic axial section of a collector incorporated into the mass spectrometer of FIG. 1.

Collector 14 is shown in detail in FIG. 3, and includes a collector member 92 which is of shallow hollow cylindrical form with an inturned flange 92a of annular form at the end thereof closest to plate 72. Housed partly within collector member 92, but positioned somewhat below the axial location of flange 92a is a slow ion deflector 94. This is of generally conical form diverging in the direction away from plate 72.

In use, the parts of the spectrometer shown are enclosed within a chamber (not shown) from which air can be evacuated. Means (also not shown) is provided for introducing into the spectrometer a gas or vapour to be analysed. Electrical potentials are applied as follows to the various component parts of the spectrometer:

(1) to anode 26, a potential of +3 kilovolts;

(2) to cathodes 22, 24 and magnets 18 and 19, a voltage V which can, for example, be in the range 0 to +40 volts;

(3) to electrodes 44, 46, a potential equal to the desired upper limit of the energy of ions to be generated by the source 12. For example, this voltage may be chosed as +100 volts plus V volts.

(4) to electrode 48 and plate 72, a potential of zero volts.

(5) to one pair of opposed rods 70, a potential $V_{ac}\cos(\omega t)+U_{d.c.}$ Typically, $V_{ac}$ may, for quadrupole rods 15 mm in diameter, be about 0.168 $V_{ac}$. The frequency, f, equal to $\omega/2\pi$may typically be about 5 MHZ. These parameters are, however, selected in accordance with known practice, on the basis of known relationships between ion mass, quadrupole dimensions, frequency f and applied potential.

(1) to the other pair of opposed rods of filter 10, a potential $V_{ac}\cos(\omega t+\pi)-U_{d.c.}$.

(7) to slow ion deflector 94, a small positive potential. This may be selected as being equal to the potential applied to cathodes 22, 24 plus an additional voltage such as 50 volts.

(8) collector member 92 is also substantially at earth potential, being connected to earth via a suitable measuring device 96.

The operation of spectrometer 8, with the above applied potentials, is generally in accordance with known practice, the applied alternating potentials to the rods of the filter 10 causing a scanning effect over a period of such scanning so that ions from source 12 and of different particular energies pass through the filter 10 in a manner such that, at each instant of time in the scan period, only ions with a particular mass within the scanned range will pass through the filter. Ions of this mass will pass on the generally sinuous path 100 shown in FIG. 1, through the mass filter 10 and through the plate 72 where they are attracted by collector member 92 and deflected to strike this. The thus collected ions cause detector 96 to register a current flow. Since slow ion deflector 94 is at a slight positive potential, this tends to repel ions from filter 10 and assist in the direction of these towards the collector 92.

Ions from source 12 which, although in an energy range for passage through the filter 10, are not of mass defined by the filter parameters in the scanning cycle for such passage, will be deflected so as to strike one of the rods 70 as indicated by the path 102 in FIG. 1.

Figure 4:
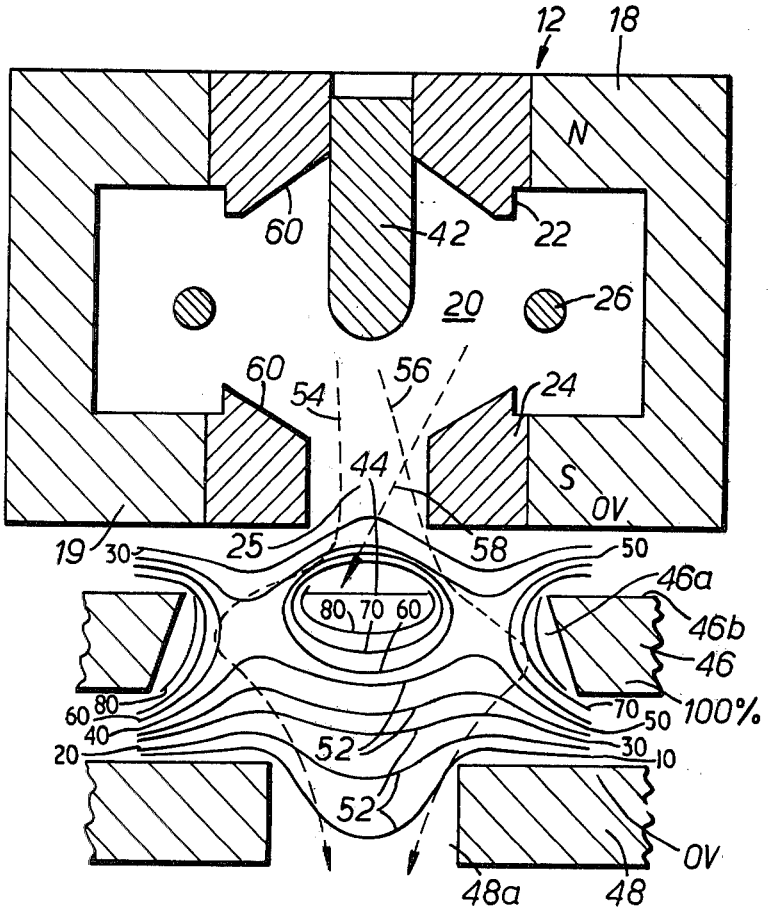
FIG. 4 is a diagrammatic axial section of an ion source constructed in accordance with the invention.

Reverting now to FIG. 4, contour lines 52 show the approximate configuration of the electric field produced in use of source 12 around the electrode 44, the figures at each end of these lines 52 representing percentages of the voltage applied to electrode 46 which prevail along the so-identified line.

Broken lines 54, 56 show paths of movement of ions moving from the space 20 past the cathode 24 and thence axially towards electrode 48, these being paths of movement for ions having energies below a selected upper limit for passage through the electrode structure comprised of electrodes 44, 46, 48. As will be seen, these ions are deflected around the electrode 44, pass through the opening 50, and are thence directed through the central opening 48a in electrode 48. On the other hand, ions of higher energy than this, such as illustrated by ion path 58 in FIG. 4, are not so deflected around the electrode 44 and will directly strike this or, if they do not strike electrode 44, they will pass through the gap 50 at such an angle as to strike electrode 48 rather than pass through opening 48a.

The element 42 assists in operation of the source 12 by increasing the numbers of ions produced. The yield of ions is also improved by the configuration of the magnetic pole pieces which are formed by the cathodes 22 and 24 (the latter being formed of magnetic material as shown). In particular, each cathode 22, 24 presents an inclined annular surface 60 aligned on the axis of the source with these surfaces 60 each being convergent in directions away from the anode 26. The shaping so produced results in some magnetic field compression above the opening 25.

By the above construction of the source 12, it is possible to discriminate against emission from opening 48a of ions having energies above a certain level, such as indicated by the line 61 in FIG. 5. The maximum energy level for passage from the opening 48a is established by the voltage applied to the electrodes 44, 46.

The collector 14 described has the particular advantage that uncharged excited molecules or electromagnetic radiation from ion source 12 which would tend to pass on a straight line through filter 10, will be undeflected by potential on collector member 92, and simply strike slow ion deflector 94. Such particles and electromagnetic radiation will thus not cause generation of spurious signals in detector 96. In the particular case described here, the use of the collector in this form provides a further advantage that if it should be that, by chance occurrence, relatively high energy ions are generated in device 12 and which are of too high an energy level to be satisfactorily filtered in filter 10, these will also tend to travel on straight line paths through filter 10 such as indicated by the line 68 in FIG. 1, and these, instead of striking collector member 92, will pass immediately to slow ion deflector 94, by virtue of their energy being sufficient to overcome the positive potential applied to the collector member 92.

In an experimental ion source 12 constructed in accordance with FIG. 4, the anode was 10 mm in diameter and the cathodes 22, 24 (in the form of soft iron pole pieces) were 10 mm apart. The opening 25 was 4 mm in diameter. The energy distribution of transmitted ions from the source through opening 48a was measured. It was found that the sensitivity (without any filtering through mass filter 10) was $1\times10^{-3}$ A/torr, this being a maximum value which occurred at 80 electron volts energy for emergent ions. In general operation, the electrodes 44, 46 had a potential of 100 volts applied thereto and it was found that this effectively eliminated selection of ions so that only ions having energy levels to the left of the lines 61 of FIG. 5 were passed through opening 48*a*. When the source 12 was used with the mass filter 10 and ion collector 14 as shown in FIG. 1, the resultant assembly was such that the minimum detectable leak detectable by using the spectrometer as a helium monitor in a leak-detector system, was $1\times10^{-8}$ std. cc per sec. However, it will be appreciated that use of the source 12 is not confined to use in a mass spectrometer.

Use of the source 12 has also been found to give substantially complete elimination of pressure background effects normally present in cold cathode mass spectrometric systems and further to result in substantial elimination of contamination of the filter 10 itself through fast ion discharge on the rods 70 and on the ion collector 14. There is no particular pressure range for operation and pressures up to about $10^{-3}$ torr can be employed, whereas, generally, pressures less than $10^{-4}$ torr must be employed with filament type ion sources when used in mass spectroscopy. Aside from these advantages, the ion source 12 itself forms a convenient pressure gauge for either controlling the operation of the spectrometer itself or of associated systems. The current flow between the anode and the cathodes can be measured and bears a well known predetermined relationship to the pressure within the source 12. It is preferred, in this connection, to so arrange the spectrometer so that the ion source 12 is somewhat isolated from the remainder of the interior of the apparatus. For example, electrode 48 can be used to partition the enclosing structure so that the source 12 is within one substantially closed compartment and the filter 10 and collector 14 are within another substantially closed compartment, with the opening 48*a* in electrode 48 providing the only communication between these. By this means, if pumping is effected from the compartment enclosing the filter and collector, there can be a relatively low pressure within the analysing regions of the spectrometer than prevails within the source 12. This permits the number of atoms and molecules in the source compartment to be relatively increased, while still permitting an ample mean free path of movement for the ions passing through the spectrometer in the compartment housing the filter and collector.

Figure 6:
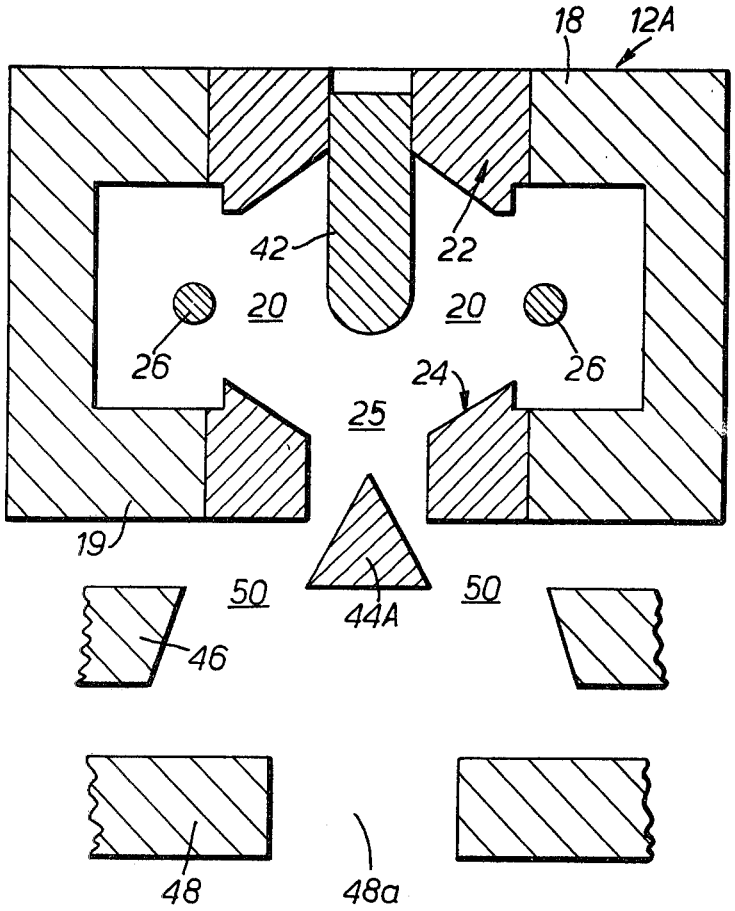
FIG. 6 is an axial cross-section of a further ion source constructed in accordance with the invention.

FIG. 6 shows a modified source 12A in which the electrode 44 is replaced by a conical electrode 44A. This modified electrode 44A has been found to provide slightly superior definition of the required electrostatic field around the gap 50. In this case, as well as in the case of the arrangement of FIG. 4, the electrodes 44 or 44A may be electrically connected to electrode 46 (such as being supported therefrom by a fine wire) or may be electrically insulated from electrode 46. In the first case, the electrode 44 or 44 will, of course, be at the same potential as electrode 46, whilst in the second case, the electrode 44, 44A may be, if desired, maintained at a potential which is different to that which prevails at electrode 46. It has been found, in this connection, that the added flexibility of operation provided by the latter arrangement is advantageous. For example, in such instance, it has been found that improved performance can be achieved by varying the electrical potentials as applied to the electrode 46 and to the electrode 44 or 44A so that the electrode 44 or 44A has a potential of 50 volts thereon and electrode 46 has a potential of 150 volts thereon, rather than by applying the voltage mentioned above thereto.

Where the electrode 44*a* is employed, it is preferably dimensioned to optically occlude the opening 25, such as by making the opening 25 4 mm in diameter as described and making the base diameter of the cone 5 mm.

The described ion source and spectrometer have been advanced merely by way of explanation and many modifications may be made without departing from the spirit and scope of the invention as defined in the claims hereto.

I claim:

1. An ion source for generating ions of a gas or vapour and comprising two cathodes spaced apart on the axis of the source, an anode interposed between the cathodes, said anode being of generally annular cross-section transverse to said axis, and magnet means for generating a magnetic field aligned in the direction of said axis and extending between said cathodes, said cathodes defining therebetween a space within which said anode is positioned and into which gas or vapour is introduced for generation of said ions, one of said cathodes being apertured for exit therethrough of said ions from said space; said ion source further comprising a first electrode, a second electrode and a third electrode, said first electrode being positioned on said axis adjacent said one cathode so that said one cathode is between said first electrode and said space, said second electrode having an axially aligned first aperture and being positioned adjacent said first electrode to define therewith a generally annular opening between the peripheries of said first electrode and said first aperture, said third electrode being disposed axially away from said second electrode and farther away from said space than is said second electrode, said third electrode having a second axially aligned aperture therein, whereby, upon application to said first and second electrodes of a positive potential and to said third electrode of a potential which is negative relative to that applied to said second electrode, there is created an electrostatic field at or around said first electrode and between said second and third electrodes and directed so as to cause high energy negative ions exiting from said opening to hit the first electrode and so as to cause low energy negative ions around said first electrode to be deflected through said first aperture and thence through said second aperture.

2. An ion source as claimed in claim 1 wherein said magnet means comprises a magnet having first and second poles disposed on respective opposite axial sides of said anode, and wherein said ion source is provided with an axially elongate member of conductive but non-magnetic material which extends from one of said first and second poles of said magnet, through the said anode but spaced from the inner periphery of the anode, to terminate at a location adjacent said anode but between said anode and the other of said first and second poles.

3. An ion source as claimed in claim 1 wherein said first aperture in said second electrode is divergent in the direction away from said magnet means and toward said third electrode.

4. An ion source as claimed in claim 3 wherein said second electrode is thicker in the axial direction than said first electrode.

5. An ion source as claimed in claim 4 wherein said first electrode is in the form of a flat disc positioned with both major surfaces thereof substantially adjacent a plane containing the surface of said second electrode closest said magnet means.

6. An ion source as claimed in claim 4 wherein said first electrode is conical with its apex directed towards said magnet means and its base being substantially coplanar with a plane containing a surface of said second electrode which is closest said magnet means.

7. A mass spectrometer comprising an ion source, a collector, and an electrostatic mass filter interposed between said source and collector, the ion source comprising: two cathodes spaced apart on the axis of the source, an anode interposed between the cathodes, said anode being of generally annular cross-section transverse to said axis, and magnet means for generating a magnetic field aligned in the direction of said axis and extending between said cathodes, said cathodes defining therebetween a space within which said anode is positioned and into which gas or vapour is introduced for generation of said ions, one of said cathodes being apertured for therethrough of said ions from said space; said ion source further comprising a first electrode, a second electrode and a third electrode, said first electrode being positioned on said axis adjacent said one cathode so that said one cathode is between said first electrode and said space, said second electrode having an axially aligned first aperture and being positioned adjacent said first electrode to define therewith a generally annular opening between the peripheries of said first electrode and said first aperture, said third electrode being disposed axially away from said second electrode and farther away from said space than is said second electrode, said third electrode having a second axially aligned aperture therein, whereby, upon application to said first and second electrodes of a positive potential and to said third electrode of a potential which is negative relative to that applied to said second electrode, there is created an electrostatic field at or around said first electrode and between said second and third electrodes and directed so as to cause high energy negative ions exiting from said opening to hit the first electrode and so as to cause low energy negative ions around said first electrode to be deflected through said first aperture and thence through said second aperture;

the mass filter having predetermined electrical potentials applied thereto to cause said filter to generate an electrostatic field such that ions from said ion source and of particular energy are passed along a predetermined path from the filter to the collector; and said collector comprising: a collector member disposed away from said path and having a potential applied thereto so as to attract, from ions passing through the filter, only ions having energy levels in a particular range for which the filter is effective and such that ions of energy levels substantially above the particular range are not deflected from said path sufficiently to be collected.

8. A mass spectrometer as claimed in claim 7 wherein said collector member is of cylindrical form concentric with the axis of the mass spectrometer, with an inwardly directed flange at the end thereof closest the filter.

9. A mass spectrometer as claimed in claim 8 wherein a further member is positioned substantially on said axis so that said collector member extends substantially therearound, the further member being arranged to carry a second electrical potential so as to repel ions of energy within said range but such that ions of energy substantially above said range are able to continue substantially undeflected thereto from the filter.

* * * * *